US006062681A

United States Patent [19]

Field et al.

[11] Patent Number: 6,062,681

[45] Date of Patent: May 16, 2000

[54] BUBBLE VALVE AND BUBBLE VALVE-BASED PRESSURE REGULATOR

[75] Inventors: Leslie A. Field, Portola Valley; Stefano Schiaffino, Menlo Park; Phillip W. Barth, Portola Valley; Storrs T. Hoen, Brisbane, all of Calif.; Naoto A. Kawamura, Corvallis, Oreg.; David K. Donald, Mountain View; Channing R. Robertson, Stanford, both of Calif.; Jonathan D. Servaites, Anapolis, Md.

[73] Assignee: Hewlett-Packard Company, Palo Alto, Calif.

[21] Appl. No.: 09/114,978

[22] Filed: Jul. 14, 1998

[51] Int. Cl.[7] ..... B41J 2/05

[52] U.S. Cl. ..... 347/65; 347/92; 347/85; 417/208

[58] Field of Search ..... 417/208, 209; 137/828, 341, 13; 347/65, 92, 85

[56] References Cited

U.S. PATENT DOCUMENTS

| | | | |
|---|---|---|---|
| 4,535,343 | 8/1985 | Wright et al. | 346/140 R |
| 4,698,645 | 10/1987 | Inamoto | 347/65 |
| 5,058,856 | 10/1991 | Gordon et al. | 251/11 |
| 5,300,959 | 4/1994 | McClelland et al. | 346/140 R |
| 5,350,616 | 9/1994 | Pan et al. | 428/131 |
| 5,479,196 | 12/1995 | Inada | 347/92 |
| 5,635,968 | 6/1997 | Bhaskar et al. | 347/59 |
| 5,699,462 | 12/1997 | Fouquet et al. | 385/18 |
| 5,751,317 | 5/1998 | Peeters et al. | 347/65 |
| 5,777,649 | 7/1998 | Otsuka et al. | 347/94 |
| 5,793,393 | 8/1998 | Coven | 347/65 |
| 5,867,195 | 2/1999 | Kaneko et al. | 347/92 |
| 5,946,015 | 8/1999 | Courtney | 347/92 |
| 5,969,736 | 10/1999 | Field et al. | 347/85 |
| 6,003,977 | 12/1999 | Weber et al. | 347/63 |
| 6,007,187 | 12/1999 | Kashino et al. | 347/65 |

OTHER PUBLICATIONS

Thomas K. Jun and Chang–Jin Kim, "Microscale Pumping with Transversing Bubbles in Microchannels", Solid State Sensor and Actuator Workshop, Hilton Head, South Carolina, Jun. 2–6, 1996, pp. 144–147.

Liwei Lin, "Selective Encapsulations of MEMS: Micro Channels, Needles, Rsonators and Electromechanical Filters", Dissertation University of California at Berkeley, 1993.

*Primary Examiner*—Charles G. Freay
*Assistant Examiner*—Robert Z. Evora

[57] ABSTRACT

A bubble valve that comprises a liquid delivery channel and a localized heating arrangement. The liquid delivery channel includes an upstream portion and a constriction downstream of the upstream portion. The constriction has a smaller cross-sectional area than the upstream portion. The localized heating arrangement is located in the liquid delivery channel and generates heat to nucleate and enlarge a bubble in the liquid. The constriction is shaped to form a seal with the bubble. The localized heating arrangement additionally generates heat to move the bubble relative to the constriction to control the flow of the liquid. A pressure regulator that comprises a liquid delivery channel connected to a liquid outlet, a sensor located adjacent the liquid outlet, a controller that operates in response to the sensor and a localized heating arrangement. The liquid delivery channel includes an upstream portion, and a constriction located between the upstream portion and the liquid outlet. The constriction has a smaller cross-sectional area than the upstream portion. The localized heating arrangement is located in the liquid delivery channel and generates heat in response to the controller to nucleate and enlarge a bubble in the liquid. The constriction is shaped to form a seal with the bubble. The localized heating arrangement additionally generates heat to move the bubble relative to the constriction to control the flow of the liquid to the liquid outlet.

28 Claims, 8 Drawing Sheets

BUBBLE VALVE AND BUBBLE VALVE-BASED PRESSURE REGULATOR

FIELD OF THE INVENTION

The invention relates to pressure regulation for liquids, and more particularly, to a method and device that uses a bubble valve to control the flow of ink to the firing chamber in the print head of an inkjet printer.

BACKGROUND OF THE INVENTION

As the number of homes and businesses that acquire computer equipment grows, the need for reliable, fast and cost-effective printers also continues to grow. In recent years, the print quality of inkjet printers has improved greatly to the extent that it now rivals that of laser printers.

The print head of an inkjet printer forms part of a print cartridge that is mounted in a carriage that moves the print cartridge back and forth across the paper. The print head includes many orifices, typically arranged in line aligned parallel to the direction in which the paper is moved through the printer and perpendicular to the direction of motion of the print head. Each orifice constitutes the outlet of a firing chamber in which is located a firing element such as a heating element or piezoelectric element. The firing element operates in response to an electrical signal to cause minute droplets of ink to be ejected from the orifice. Ink from a reservoir is supplied to the firing chambers through an ink manifold in the print head. When printing, a page is fed through the printer while the carriage moves the print cartridge, including the print head, back and forth across the page, to enable the print head to deliver ink to the paper. The rapid motion of the print cartridge during printing, variations in ink viscosity, temperature and altitude all contribute to difficulties in regulating the pressure at which the ink is delivered to each firing chamber in the print head.

In a so-called "on axis" arrangement, the print cartridge of an inkjet printer typically includes an ink reservoir located behind the print head. In newer inkjet printers that have an "off axis" arrangement, only a small amount of ink is stored in the print cartridge, and the main ink reservoir is positioned at a location remote from the print head. In the off-axis arrangement, an ink delivery tube delivers ink from the remote reservoir to the print cartridge. The ink delivery tube is considerably longer than the length of the ink delivery path in a typical on-axis print head. The off-axis arrangement reduces the mass of the print cartridge, which enables the print speed to be increased, or the power consumption of the carriage scanning mechanism to be reduced. The off-axis arrangement additionally provides the option of an increased ink storage capacity. However, the off-axis arrangement requires a pump or a gravity feed arrangement to deliver the ink through the ink delivery tube, and movement of the print cartridge causes the ink delivery tube to flex. Both of these factors compound the above-discussed difficulties in regulating the pressure at which ink is delivered to the print head.

In both on-axis and off-axis configurations, maintaining a predetermined ink pressure at the firing chamber is critical to an orifice delivering the expected amount of ink to the paper when the firing element operates. While some ink pressure regulation methods and devices regulate the ink pressure to a given absolute pressure, better ink pressure regulation methods and devices regulate the pressure of the ink in the firing chamber to a predetermined pressure below atmospheric pressure, since an ink pressure in the firing chamber equal to or greater than atmospheric pressure will cause ink to leak from the orifice. Therefore, the ink pressure in the firing chamber should be maintained below atmospheric pressure to prevent the ink from leaking. On the other hand, too large a difference between the ink pressure in the firing chamber and atmospheric pressure will result in insufficient ink being delivered to the paper during printing. Accordingly, the difference between the ink pressure in the firing chamber and atmospheric pressure should be maintained within a predetermined range.

Spring-bag ink reservoir devices are widely used to regulate the ink pressure in the firing chambers of inkjet printers. In a spring-bag device, as the bag empties, the spring keeps ink stored in the bag at a constant pressure. This keeps the ink delivered to the firing chamber at a constant pressure. Additional measures are required to keep the difference between the ink pressure in the firing chamber and atmospheric pressure within a predetermined range.

U.S. Pat. No. 4,771,295 to Baker and assigned to the assignee of the present disclosure describes using a reticulated polyurethane foam placed in the ink reservoir to control ink pressure. Such an arrangement reduces the volume of ink that can be stored in a reservoir of a given size, however. Moreover, the regulated ink pressure varies due to variations in the size of the pores in the foam.

U.S. Pat. No. 4,794,409 to Cowger et al. and assigned to the assignee of the present disclosure describes an ink jet print head composed of a primary ink reservoir, a secondary reservoir and an orifice all interconnected by a porous member such as foam. As the pressure in the primary ink reservoir changes relative to ambient pressure, ink is drawn through the foam back and forth between the primary and secondary reservoirs.

U.S. Pat. No. 4,791,438 to Hanson et al. describes an inkjet print head having a primary ink reservoir, a secondary reservoir and a capillary member interconnecting the reservoirs. As the pressure in the primary ink reservoir changes relative to ambient pressure, ink is drawn through the capillary back and forth between the primary and secondary reservoirs.

U.S. Pat. No. 5,010,354 of Cowger et al., assigned to the assignee of the present disclosure, and entitled *Ink Jet with Improved Volumetric Efficiency*, describes a device in which a chamber containing a capillary volume element is directly coupled to an ink reservoir. Pressure in the ink reservoir is defined by a bubble generator coupled to the ink reservoir. A portion of the ink reservoir remote from the chamber is coupled to the print head. Pressure in the capillary volume element is greater than the normal sub-atmospheric pressure in the ink reservoir, but is less than atmospheric pressure. During operation at ambient pressures and temperatures within a normal range, ink does not enter the capillary volume element. When subject to temperatures and pressures outside the normal range, an increased pressure in the reservoir forces ink into the capillary volume element. This limits the pressure increase in the ink reservoir and prevents ink from being ejected from the print head. As the pressure in the ink reservoir returns to the normal range, the ink reservoir draws ink from the capillary volume element. In this arrangement, the capillary element acts a pressure surge protector for the ink reservoir. Since the capillary volume element controls the pressure in the ink reservoir, its volume must be of the same order as that of the ink reservoir. Thus, this arrangement suffers from the drawbacks that the mass of the capillary volume element increases the total mass of the print head, and the capillary volume element is complex to manufacture.

Valves can be used to control the flow of ink to the print head, and therefore the pressure at which the ink is delivered to the firing chambers in the print head. While non-mechanical, passive valves such as deformable membranes can be used, such valves require separate fabrication and subsequent installation in the print head. It would be preferable to use a valve that can be fabricated using the same fabrication processing as is used to fabricate the print head.

In *Microscale Pumping with Traversing Bubbles in Microchannels*, SOLID-STATE SENSOR AND ACTUATOR WORKSHOP, HILTON HEAD, SOUTH CAROLINA, 144–147 (Jun. 2–6, 1996) Thomas K. Jun and Chang-Jin Kim suggest that a stationary vapor bubble formed by boiling a liquid flowing through a channel could serve as an obstruction against flow in the channel and therefore function as a valve. However, such a valve is impractical in a typical liquid that includes dissolved gas because flow of liquid cannot easily be restored. Heating such a liquid releases the dissolved gas from the liquid. The dissolved gas released from the liquid forms a gas bubble that does not immediately collapse when heating is discontinued. Moreover, such a valve has a breakdown pressure less than the maximum of the range of ink delivery pressures typically used in ink jet printer print heads. The breakdown pressure is the pressure applied to the valve in its closed state that will drive the bubble downstream, thus forcing the closed valve open.

The dissertation of Liwei Lin, entitled *Selective Encapsulations of* [*Micro Electro-Mechanical Systems*]*: Micro Channels, Needles, Resonators and Electro-mechanical Filters*, University of California at Berkeley, 1993, also describes forming and moving bubbles within microchannels. The bubbles were formed by using microheaters to heat the liquid to a temperature close to its critical temperature. This dissertation also describes the effect of the shape of the flow channel on the preferred direction of movement of the bubble.

Finally, U.S. Pat. No. 5,699,462 of Fouquet et al., entitled *Total Internal Reflection Optical Switches Employing Thermal Activation*, and assigned to the assignee of this application, describes using gas or vapor bubbles as switching elements for controlling the passage of optical communication signals through waveguides. This patent describes expanding the width of the trench in which the bubble is located to promote movement of the bubble along the trench.

Although the above disclosures describe some basic characteristics of bubble mechanics, and suggest that a bubble can be used to obstruct the flow of a liquid in a channel, a practical way of using bubbles to provide a valve to control the flow of ink to the print head of an ink jet printer, and hence to regulate the pressure of the ink in the print head, has not yet been shown. Moreover, if bubbles are used to regulate the flow of ink in an ink jet printer, a way must be found to prevent the bubbles from entering the print head where they could cause print quality problems by preventing ink from flowing into the firing chambers.

What is needed is a bubble valve that can be used to control the flow of ink to the print head of an ink jet printer, and hence to regulate the pressure of the ink in the print head to a predetermined differential below atmospheric pressure. What is also needed is a bubble valve that provides such ink flow control without significantly increasing the manufacturing complexity of the print head, and that does not significantly increase the mass of the print head. Finally what is needed is a bubble valve structure that confines the bubbles to the location of the valve structure and prevents the bubbles from flowing downstream into the print head.

SUMMARY OF THE INVENTION

The invention provides a bubble valve for controlling flow of a liquid in a flow direction. The bubble valve comprises a liquid delivery channel and a localized heating arrangement. The liquid delivery channel includes an upstream portion and a constriction downstream of the upstream portion. The constriction includes an opening having a smaller cross-sectional area than that of the upstream portion. The localized heating arrangement is located in the liquid delivery channel and generates heat to nucleate and enlarge a bubble in the liquid. The constriction is shaped to form a seal with the bubble. The localized heating arrangement additionally generates heat to move the bubble relative to the constriction to control the flow of the liquid.

The localized heating arrangement may include a downstream heater located adjacent the constriction, and an upstream heater located upstream of the downstream heater.

The liquid delivery channel may additionally include a side branch located at or upstream of the constriction and the localized heating arrangement may include a downstream heater located adjacent the constriction, and an upstream heater located in the side branch.

The constriction may comprise a region in which the cross-sectional area of the liquid delivery channel reduces progressively, a region in which the cross-sectional area of the liquid delivery channel reduces abruptly or a grate located in the liquid delivery channel.

The bubble valve may additionally comprise a flared channel having a cross-sectional area that increases along its length and the localized heating arrangement may move the bubble relative to the constriction by expanding the bubble into contact with the flared channel. Contact between the bubble and the flared channel generates a force that moves the bubble along the length of the flared channel.

The bubble valve may additionally comprise a bubble extractor extending from the liquid delivery path upstream of the constriction.

The liquid delivery channel may include a floor and side walls that form square corners with the floor, and the bubble valve may additionally comprise fillets filling the square corners between the sidewalls and the floor of the liquid delivery channel to improve the effectiveness of the seal between the bubble and the constriction.

The bubble valve may additionally comprise a pressure regulator coupled to the liquid delivery channel downstream of the constriction and including an array of capillaries.

The invention also provides a pressure regulator for regulating the pressure at which a liquid is delivered to a liquid outlet. The pressure regulator comprises a liquid delivery channel connected to the liquid outlet, a sensor located adjacent the liquid outlet, a controller that operates in response to the sensor and a localized heating arrangement. The liquid delivery channel includes an upstream portion, and a constriction located between the upstream portion and the liquid outlet. The constriction includes an opening having a smaller cross-sectional area than that of the upstream portion. The localized heating arrangement is located in the liquid delivery channel and generates heat in response to the controller to nucleate and enlarge a bubble in the liquid. The constriction is shaped to form a seal with the bubble. The localized heating arrangement additionally generates heat to move the bubble relative to the constriction to control the flow of the liquid to the liquid outlet.

The localized heating arrangement may include a downstream heater located adjacent the constriction, and an upstream heater located upstream of the downstream heater.

The liquid delivery channel may additionally include a side branch located at or upstream of the constriction and the localized heating arrangement may include a downstream heater located adjacent the constriction, and an upstream heater located in the side branch.

The constriction may comprise a region in which the cross-sectional area of the liquid delivery channel reduces progressively, a region in which the cross-sectional area of the liquid delivery channel reduces abruptly or a grate located in the liquid delivery channel.

The pressure regulator may additionally comprise a bubble extractor extending from the liquid delivery channel upstream of the constriction.

The pressure regulator may additionally comprise a secondary pressure regulator located adjacent the liquid outlet.

DETAILED DESCRIPTION OF THE INVENTION

Figure 1A:
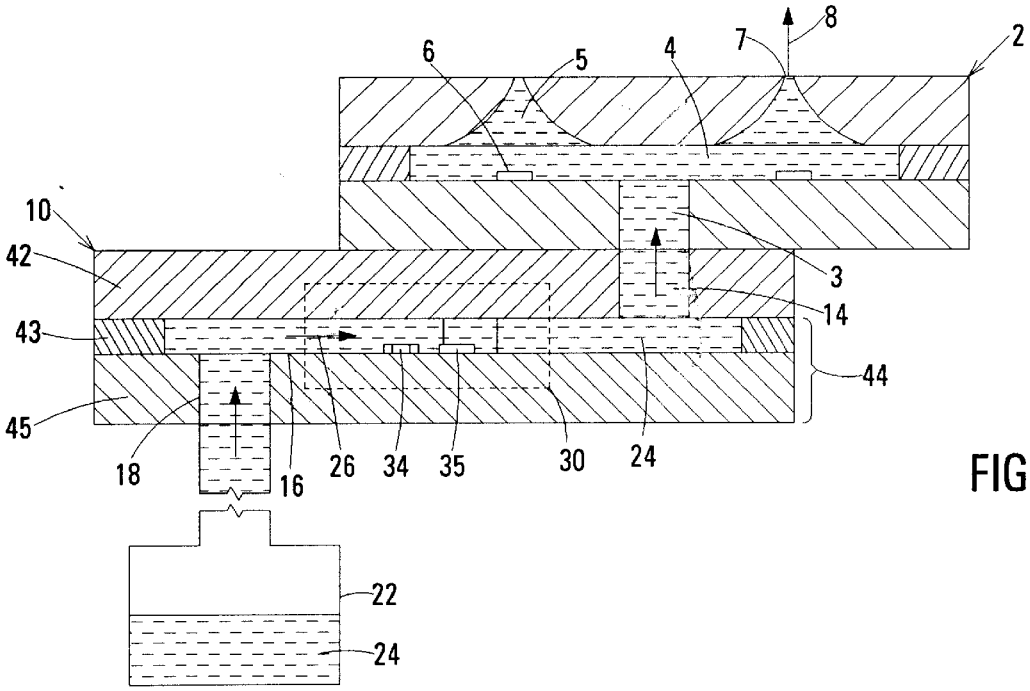
FIG. 1A is a cross-sectional view of a first embodiment of a pressure regulator according to the invention incorporating a first embodiment of a bubble valve according to the invention. The pressure regulator is shown attached to the print head of an ink-jet printer.

The pressure at which ink is delivered to the firing chambers in the print head of an inkjet printer should be regulated to a predetermined pressure differential below atmospheric pressure. This ensures that, during printing, the firing elements eject the expected quantity of ink from the orifices of the firing chambers and prevents ink from leaking from the orifices when printing is not being performed. If the differential pressure at which ink is delivered to the firing chambers in the print head is too high, then less than the expected amount of ink will be ejected from the orifices. If the differential pressure at which ink is delivered to the print head is too low, i.e., the absolute pressure of the ink is too high, then the firing elements will eject more than the appropriate amount of ink from the orifices, and ink could be expelled from the orifices without the firing elements operating.

The bubble valve-based pressure regulator according to the invention maintains the pressure at which ink is delivered to the firing chambers in the print head at a predetermined differential below atmospheric pressure. The pressure regulator enables the expected quantity of ink to be ejected from the orifices during printing and prevents ink from leaking from the orifices. The pressure regulator is cost-efficient and can be manufactured in a way that allows design changes to be incorporated quickly and at relatively low cost. The pressure regulator may also be incorporated in other devices in which the pressure of a liquid is to be regulated to a predetermined differential below an ambient pressure. The bubble valve according to the invention may be used in other applications in which the flow of a liquid needs to be controlled.

The bubble valve according to the invention operates to control the flow of ink through an elongate ink delivery channel. The ink delivery channel is shaped to define a constriction that includes an opening whose cross-sectional area is less than that of the ink delivery channel upstream of the constriction. Heaters nucleate and enlarge a bubble of ink vapor (a vapor bubble) or dissolved gas (a gas bubble) in the ink and can move the position of the bubble relative to the constriction. The constriction is additionally shaped to form a seal with the bubble. When the bubble contacts the constriction, it forms a seal that stops or substantially reduces the ink flow. This constitutes the closed state of the bubble valve. Moving the bubble away from the constriction allows the flow of ink to resume. This constitutes the open state of the bubble valve. In some embodiments, the bubble moves relative to the constriction along the long axis of the ink delivery channel; in other embodiments, the direction of movement is substantially perpendicular to the long axis.

In the bubble valve according to the invention, the bubble is nucleated, enlarged and moved by a localized heating arrangement. In some of the embodiments of the bubble valve according to the invention, the localized heating arrangement moves the bubble relative to the constriction by generating a temperature gradient in the ink. The temperature gradient moves the bubble from a lower-temperature region towards a higher-temperature region by thermocapillary action. In other embodiments of the bubble valve according to the invention, the localized heating arrangement moves the bubble relative to the constriction by expanding the bubble into contact with a flared channel formed in the bubble valve. Contact between the bubble and the flared channel moves the bubble in the direction in which the cross-sectional area of the flared channel increases.

The bubble valve according to the invention is characterized by three main parameters. The breakdown pressure is the ink pressure applied to the closed valve that will drive the bubble downstream of the constriction, thus forcing the closed valve open. The leakage flow rate is the flow rate through the valve in its closed state in response to a given applied pressure. The open flow rate is the flow rate through the valve in its open state in response to a given applied pressure. Desirable bubble valve characteristics are a high breakdown pressure, a low leakage flow rate and a high open flow rate.

In the bubble valve according to the invention, the constriction is shaped to provide a surface against which the bubble forms a seal when the valve is in its closed state. The shaped constriction reduces the leakage flow rate of the bubble valve. The constriction additionally provides a physical anchor for the bubble when the valve is in its closed state. This increases the breakdown pressure of the bubble valve according to the invention compared with a bubble valve that relies on thermal gradients to hold the bubble in place blocking the ink delivery channel.

In the pressure regulator according to the invention, a bubble valve according to the invention operates in response to a sensor to control the flow of ink through the ink delivery channel and therefore to regulate the pressure at which the ink is delivered to an ink outlet.

Embodiments of the bubble valve according to the invention and the pressure regulator according to the invention will now be described with reference to an example in which the bubble valve forms part of the pressure regulator, and the pressure regulator regulates the pressure at which ink is delivered to the print head of an ink jet printer. In the examples to be described, the pressure regulator is embodied in a chip that fits behind the print head when the print head is mounted in the print cartridge. However, the bubble valve-based pressure regulator could alternatively be integrated into the print head or incorporated elsewhere in the ink flow path to the print head.

FIG. 1A shows a print head on which a first embodiment of a pressure regulator according to the invention is mounted. The pressure regulator incorporates a first embodiment of a bubble valve according to the invention. Additional views of the pressure regulator are shown in FIGS. 1B–1H. To clarify the drawings, the ink 24 is shown with shading only in FIG. 1A. In the first embodiment of the pressure regulator, two heaters are located in tandem in the ink delivery channel upstream of the constriction. One heater is located adjacent the constriction; the other is located further upstream. The heaters are selectively activated to nucleate and enlarge the bubble, to move the bubble downstream to close the valve and to move the bubble upstream to open the valve.

FIG. 1A shows the pressure regulator 10 mounted behind the print head 2. The pressure regulator and the print head form part of a print cartridge (not shown). In the example shown, the pressure regulator and the print head are shown as separate components. Alternatively, the pressure regulator may share elements with the print head.

In the print head 2, ink 24 is received from the pressure regulator 10 through the ink input 3. The manifold 4 distributes the ink to the individual firing chambers, an exemplary one of which is shown at 5. In response to a control signal, the firing element 6, which may be a micro heater or a piezoelectric element, for example, located in the firing chamber causes the orifice 7 to direct minute drops of the ink towards the paper (not shown) in the direction indicated by the arrow 8. The number of firing chambers, orifices and firing elements shown is greatly reduced to simplify the drawing.

The pressure regulator 10 includes the ink outlet 14, the ink delivery channel 16, the ink inlet 18, and the bubble valve 30. The pressure regulator additionally includes the sensor 38 and the controller shown schematically at 37 in FIG. 1C. The ink delivery channel connects the ink outlet to the ink inlet in a manner that allows ink to flow from the ink inlet to the ink outlet when the bubble valve is open. The pressure regulator receives ink 24 at the ink inlet 18. The ink is supplied by the ink reservoir shown schematically at 22. The ink reservoir may form part of the print cartridge (not shown), or may be connected to the print cartridge by an ink delivery tube (not shown). The ink flows through the ink delivery channel from the ink inlet to the ink outlet in the direction indicated by the arrow 26. This direction coincides with the long axis of the ink delivery channel. The ink outlet 14 is in fluid communication with the ink input 3 of the print head 2.

Figure 1B:
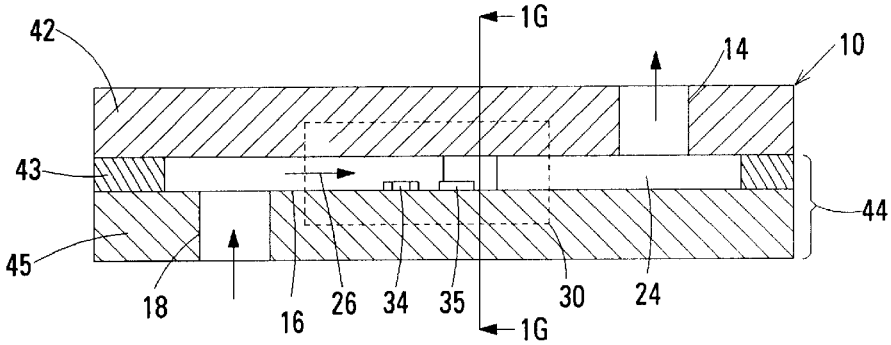
FIG. 1B is a cross-sectional view of the first embodiment of the pressure regulator and bubble valve according to the invention in which the ink is shown unshaded to show the structural features of the pressure regulator more clearly.
Figure 1C:
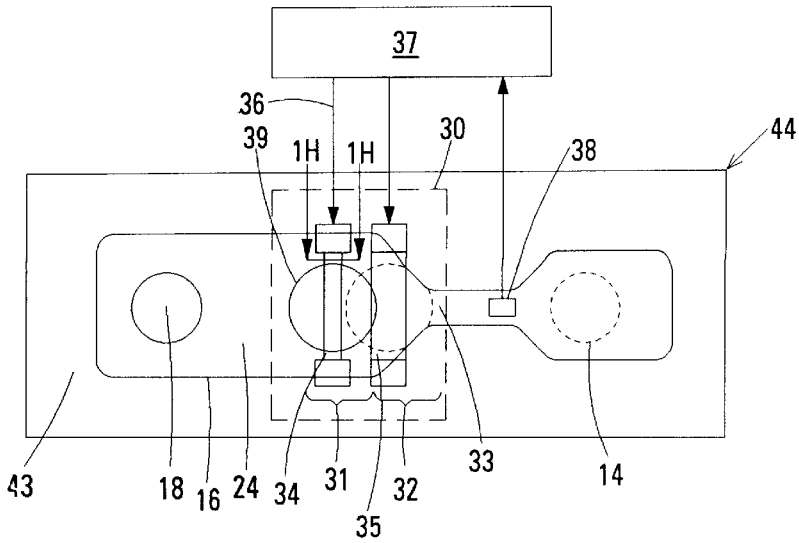
FIG. 1C is a top view of the chip that forms part of the embodiment of the pressure regulator shown in FIG. 1B.

Turning now to FIGS. 1C–1H, and, in particular to FIG. 1C, the bubble valve 30 according to the invention is composed of the contoured ink delivery channel 16 that includes the upstream portion 31 and the constriction 32, and a heater arrangement composed of the upstream heater 34 and the downstream heater 35. The constriction includes the opening 33 that has a smaller cross-sectional area than the upstream portion of the ink delivery channel. The constriction is shaped to form a seal with a bubble formed when the heater arrangement heats the ink flowing through the ink delivery channel. Thus, the opening in the constriction has a smaller width, and may additionally or alternatively have a smaller height, than the upstream portion of the ink delivery channel.

In the example shown in FIG. 1C, the constriction 32 is defined by the width of the ink delivery channel 16 progressively decreasing between the upstream portion 31 and the opening 33. In the example shown in FIG. 1D, the constriction 32 is defined by an abrupt decrease in the width of the ink delivery channel between the upstream portion and the opening. In the example shown in FIGS. 1E and 1F, the grate 54 located in the ink delivery channel downstream of the upstream portion 31 forms the constriction 32. The grate is composed of an array of bars disposed perpendicular to the major surface of the substrate 45, as shown in FIG. 1F. An exemplary one of the bars is indicated at 56. The height of the ink delivery channel may additionally or alternatively decrease at the constriction.

Figure 1D:
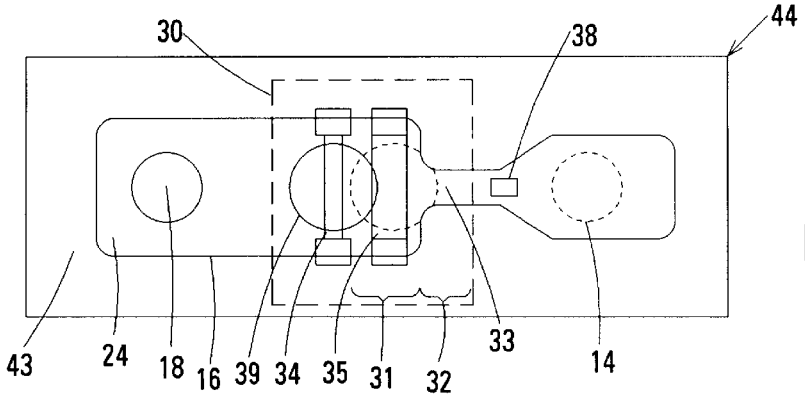
FIGS. 1D and 1E are top views of the chip that forms part of the embodiment of the pressure regulator shown in FIG. 1B showing alternative forms of the constriction.
Figure 1E:
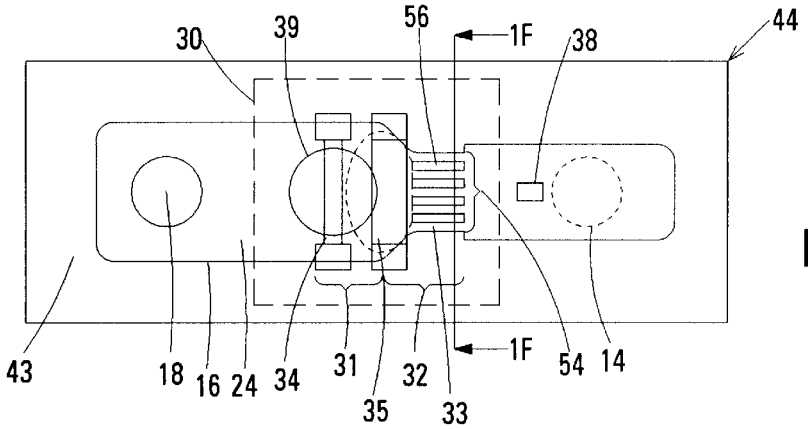
Figure 1F:
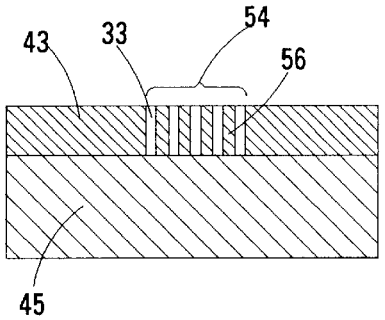
FIG. 1F is a cross-sectional view of the chip shown in FIG. 1E showing details of the grating.

The breakdown pressure of the examples of the bubble valve 30 shown in FIGS. 1C–1E is determined by the relationship between the size of the bubble 39 and the cross-sectional area of the opening 33 in the constriction 32. In the example shown in FIG. 1E, the grate 54 provides multiple narrow openings, such as the opening 33, each of whose cross-sectional areas is substantially less than that of the opening in the examples shown in FIGS. 1C and 1D. As a result, the example shown in FIG. 1E has a greater breakdown pressure, but may have a smaller open flow rate, than the other two examples.

In all three examples shown in FIGS. 1C–1F, the heaters 34 and 35 are arranged in tandem along the length of the ink delivery channel 16. The downstream heater 35 is located at the constriction. The upstream heater 34 is located in the upstream region of the ink delivery channel, upstream of the heater 3 5.

In a bubble valve for use in an ink jet printer, the breakdown pressure must be substantially greater than the maximum pressure at which ink is delivered to the ink inlet 18 to ensure that bubbles are not forced downstream of the constriction into the print head. Bubbles can cause print quality problems if allowed to enter the print head. The smaller cross-sectional area of the opening 33 in the constriction 32 compared with that of the upstream portion 31 of the ink delivery channel 16 increases the breakdown pressure of the bubble valve according to the invention relative to conventional bubble valves. The breakdown pressure of the bubble valve 30 can be well above the maximum of the normal range of ink delivery pressures at the ink inlet 18. Consequently, the bubble valve 30 can control the ink flow through the ink delivery channel without the problem of bubbles entering the downstream portion of the ink delivery channel and proceeding thence to the print head.

FIG. 1C also shows conductive tracks or other electrical conductors that electrically connect the heaters to respective outputs of the control circuit 37. An exemplary conductive track is shown at 36. The conductive tracks are shown schematically to simplify the drawing. The control circuit selectively controls the voltages or currents applied to the heaters 34 and 35 to nucleate the bubble, to control the size of the bubble, and to control the position of the bubble relative to the constriction 32. In some embodiments using vapor bubbles, the control circuit may selectively reduce the electrical input to the heaters to allow the bubble to collapse. The examples shown in FIGS. 1D and 1E also include tracks and a controller but these have been omitted to simplify the drawings.

Operation of the bubble valve 30 will now be described with reference to FIG. 1C. The control circuit 37 applies a voltage or current to the upstream heater 34 to nucleate the bubble 39 in the ink 24. Although the bubble 39 may be created by the upstream heater 34 heating the ink to a temperature close to the critical temperature of the ink to cause a volatile component of the ink to boil, it is preferred that the ink include dissolved gas, such as dissolved air. In this case, the upstream heater 34 heating the ink releases some of the gas dissolved in the ink to form the bubble. As noted above, a bubble formed by releasing dissolved gas from the ink is called a gas bubble, and a bubble formed by boiling the ink or a component of the ink is called a vapor bubble. The word bubble used alone will be understood to encompass both a gas bubble and a vapor bubble. Dissolved gas released by heating the ink does not quickly re-dissolve in the ink when heating is discontinued whereas ink vapor rapidly condenses. Consequently, a gas bubble is more stable than a vapor bubble.

After successful nucleation of the bubble 39, heating by the upstream heater 34 is continued until the bubble has expanded to a diameter in the width direction of the ink delivery channel 16 that is greater than the minimum width of the constriction 32 but less than that of the upstream region 31. The size of the bubble in the ink delivery channel can be set by appropriately choosing the dimension of the heater 34 in the width direction of the ink delivery channel and the amount of energy delivered by the heater. Although the bubble 39 partially blocks the ink delivery channel 16, an ample supply of ink can flow around the bubble to the ink outlet 14. As a result, the ink pressure in the ink outlet 14 rises towards ambient pressure. The pressure sensor 38 located in the ink delivery channel near the ink outlet has an output connected to the input of the controller 37 to enable the controller to monitor the pressure at which the ink is delivered to the ink outlet.

The maximum pressure at the ink outlet 14, i.e., the minimum pressure differential below atmospheric pressure, is limited by closing the bubble valve 30. The bubble valve is closed by moving the bubble 39 downstream into contact with the constriction 32. A bubble will move towards a heater that is hot and away from one that is cold. Thus, to counteract the rising ink pressure at the ink outlet 14, the control circuit deactivates the upstream heater 34 and activates the downstream heater 35. The resulting temperature gradient in the downstream direction causes the bubble 39 to move towards the constriction. When the bubble encounters the constriction, it forms a seal with the constriction that prevents ink from flowing to the ink outlet 14.

The demand for ink from the print head while the bubble valve 30 is closed causes the ink pressure at the ink outlet 14 to fall. When the ink pressure has reached a predetermined minimum, i.e., a predetermined maximum pressure differential below atmospheric pressure, the bubble valve must be opened again to allow additional ink to flow to the print head. This can be done in one of two ways. First, if the bubble is a vapor bubble, the controller can deactivate the downstream heater 35. This causes the vapor bubble to collapse, which opens the ink delivery channel. The controller then activates the upstream heater 34 to nucleate and enlarge a new bubble at the location of the upstream heater. Once the new bubble reaches its required size, the controller reduces the power input to the upstream heater to maintain the size of the bubble and to hold the bubble at the location of the upstream heater. Later, when the need to close the bubble valve arises, the controller deactivates the upstream heater 34 and activates the downstream heater 35 to move the bubble into contact with the constriction 32.

Second, when the bubble 39 is a gas bubble or a vapor bubble, the controller deactivates the downstream heater 35 and activates the upstream heater 34. The resulting temperature gradient draws the bubble 39 against the pressure of the ink flow back to the location of the upstream heater. The ink flow resumes once the bubble has moved out of contact with the constriction 32.

The controller 37 operates in response to the sensor shown schematically at 38. In the embodiment shown, the sensor is a pressure sensor located in the ink delivery channel 16 between the bubble valve 30 and the ink outlet 14. Alternatively, the sensor 38 may calculate the ink pressure at the ink outlet 14 by monitoring the control signals fed to the firing elements of the print head and the control signals fed to the bubble valve. The sensor calculates the pressure at the ink outlet from the balance of ink supply and demand. The flow characteristics of the ink delivery system upstream of the bubble valve are known, as are the flow characteristics of the bubble valve in its closed and open states and the quantity of ink ejected from each orifice of the print head each time its respective firing element fires. From these characteristics, the information gathered on the firings of the firing elements and the information gathered by monitoring the bubble valve control signals, the sensor calculates the ink pressure at the ink outlet. The sensor feeds an output signal indicating the calculated ink pressure to the controller 37.

In the above description, the bubble 39 is described as being nucleated and enlarged by activating the upstream heater 34. The bubble may alternatively be nucleated and enlarged by the downstream heater 35 when the bubble valve 30 needs to be closed. Using the downstream heater to nucleate and enlarge the bubble is less preferred than using the upstream heater. The ink flow velocity at the downstream heater is greater than at the upstream heater and has a greater ability to detach a newly-nucleated bubble from the downstream heater than from the upstream heater. Allowing newly-nucleated bubbles to detach from a heater is undesirable because such bubbles have a small size that enables them easily to move downstream past the constriction 32. Using the grate 58 shown in FIG. 1E as the constriction reduces the maximum size of the detached bubbles that can migrate downstream past the constriction.

Although the pressure regulator 10 can be fabricated using conventional techniques, the preferred embodiment of the pressure regulator is fabricated in part by using micromachining techniques. The use of micromachining to fabricate small mechanical structures in single-crystal silicon and other materials is known and will not be described in detail here. A large number of pressure regulators identical to the pressure regulator 10 are made simultaneously by forming the structural elements of the pressure regulators in and on a single-crystal silicon wafer, bonding the wafer to a cover sheet in which the ink outlet of each of the pressure regulators is formed, and dividing the resulting structure into individual pressure regulators. The cover sheet may be a sheet of metal or plastic, or may be another silicon wafer. Alternatively, part of the print-head may serve as the cover sheet. The ink outlet of each pressure regulator extends through the thickness of the cover sheet. Alternatively, the ink outlet of each pressure regulator may extend through the thickness of the silicon wafer.

When forming the structural elements of multiple pressure regulators in and on a single-crystal silicon wafer, the ink inlets 18 of the pressure regulators are formed by anisotropically etching through the thickness of the silicon wafer. Conventional semiconductor processing is used to form the heaters 34 and 35 of the pressure regulators, as will be described in more detail below. Conventional semiconductor processing is also used to form the electrical connections to the heaters. The barrier layer is then applied to the silicon wafer. The barrier layer may be a layer of polyimide, but other suitable organic or inorganic materials can be used instead of polyimide. In a preferred embodiment, the barrier layer is a layer of a so-called high aspect ratio photoresist, such as SU-8 epoxy-based photoresist sold by MicroChem Corp., Newton, Mass. 02164-1418. The layer of photoresist is spun on or laminated onto the substrate to form the barrier layer, and the ink delivery channels 16 of the pressure regulators are defined in the barrier layer by selectively removing parts of the barrier layer using a conventional photomasking and developing process.

Alternatively, ink delivery channels may be wholly or partly formed in the silicon wafer by selectively removing parts of the silicon wafer using a conventional photomasking, developing and etching process, for example. As a further alternative, the ink delivery channels may be wholly or partly formed in the cover sheet using a conventional photomasking, developing and etching process, or a conventional molding process, for example. When the ink delivery channels are wholly formed in the wafer or the cover sheet, the barrier layer may be omitted.

Although the ink inlet 18 is shown as extending through the thickness of the silicon substrate 45 and the ink outlet 14 is shown as extending through the thickness of the cover plate 42, the ink inlet may alternatively extend through the barrier layer 43 or the cover plate 42 and the ink outlet may alternatively extend through the barrier layer or the substrate.

FIGS. 1A and 1B show the cover plate 42 and the chip 44 that collectively form the pressure regulator 10. The cover plate 42 and the chip 44 were originally parts of the above-mentioned cover sheet and the above-mentioned silicon wafer, respectively. The chip 44 includes the silicon substrate 45 and the barrier layer 43.

Although the ink inlet 18 is shown as extending through the thickness of the silicon substrate 45 and the ink outlet 14 is shown as extending through the thickness of the cover plate 42, the ink inlet may alternatively extend through the barrier layer 43 or the cover plate 42 and the ink outlet 14 may alternatively extend through the barrier layer or the substrate.

Figure 1G:
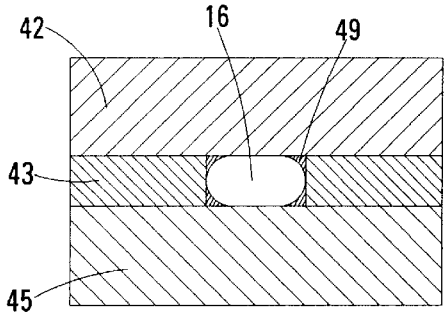
FIG. 1G is a cross-sectional view of the pressure regulator shown in FIG. 1B showing fillets located in the ink delivery channel to improve the seal that the bubble forms with the constriction.

FIG. 1G is an enlarged cross-sectional view of the pressure regulator shown in FIGS. 1B and 1D showing part of the constriction 32 in the ink delivery channel 16. It can be seen that the barrier layer 43 forms square corners with the substrate 45 and the cover plate 42, resulting in the constriction having square corners. A substantially spherical bubble cannot form a low-leakage seal with the square corners of the constriction. To enable the bubble to form a low-leakage seal with the constriction, each corner of the ink delivery channel is preferably filled with a fillet, an exemplary one of which is shown at 49.

Fillets may be formed by filling the ink delivery channel 16 with a fluid plastic material, such as epoxy, and then expelling the fluid plastic material from the ink delivery channel. Surface tension prevents the fluid plastic material from being fully expelled from the corners of the ink delivery channel, so that the corners of the ink delivery channel remain filled with fillets of the fluid plastic material. Curing the fluid plastic material leaves the corners of the ink delivery channel filled with fillets of the plastic material.

Figure 1H:
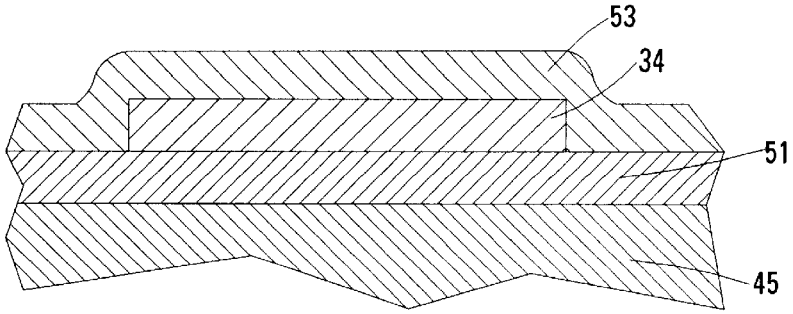
FIG. 1H is a cross-sectional view of part of the chip shown in FIG. 1C showing an example of the construction of the upstream heater.

FIG. 1H is an enlarged cross-sectional view of part of the chip 44 showing the structure of the upstream heater 34. The substrate 45, only part of which is shown, is part of a wafer of single-crystal silicon. The surface of the wafer is covered by the layer 51 of silicon dioxide. This layer may be formed by performing a wet oxidation process for example. The layer 51 provides thermal and electrical insulation between the heater and the substrate.

A layer of doped polysilicon is then deposited on the silicon dioxide layer 51 by low-pressure chemical vapor deposition (LPCVD), for example, and is then annealed to activate the dopants. Parts of the polysilicon layer are selectively removed using a plasma dry etch, for example, to define the heater 34. The downstream heater 35 is defined in the same process. Additional selective doping may then be applied to the heaters to define their conductivity profile and, hence, their heat generation profile. A layer of metal such as aluminum is then deposited on the major surface of the wafer, and is selectively removed to define the tracks electrically connecting the heaters 34 and 35 and the pressure sensor 38 to the controller 37 shown in FIG. 1C. As an alternative to polysilicon, the heaters may be formed of a metal such as nickel or tungsten, or of some other suitable resistive material.

The layer 53 of silicon nitride covers the heaters 34 and 35 and the tracks (not shown) connected to the heaters. The silicon nitride may be deposited by a low-pressure chemical vapor deposition (LPCVD) process, for example. The layer 53 provides electrical insulation and physical isolation between the heater and the ink.

The controller 37 may be additionally formed on and under the surface of the substrate 45 using conventional semiconductor circuit fabrication techniques prior to depositing the silicon dioxide layer 51. In this case, windows are formed in the silicon dioxide layer 51 to enable the conductive tracks to connect to the controller.

When the bubble valve 30 opens, a substantial temperature gradient is required to draw the bubble 39 upstream from the downstream heater 35 to the upstream heater 34 against the pressure of the ink. High ink pressures may prevent the bubble valve from opening. Moreover, as noted above, the flow of ink over the heaters 34 and 35 reduces the reliability of nucleating and enlarging a bubble and entails the risk of the ink flow carrying newly-nucleated bubbles downstream past the constriction.

Figure 2A:
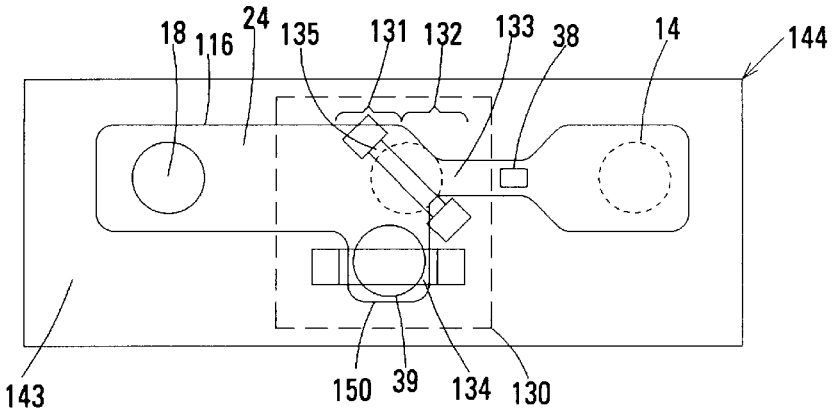
FIG. 2A is a top view of the chip that forms part of a second embodiment of a pressure regulator according to the invention incorporating a second embodiment of a bubble valve according to the invention. In this embodiment, the ink delivery channel includes a side-branch located at the constriction.
Figure 2B:
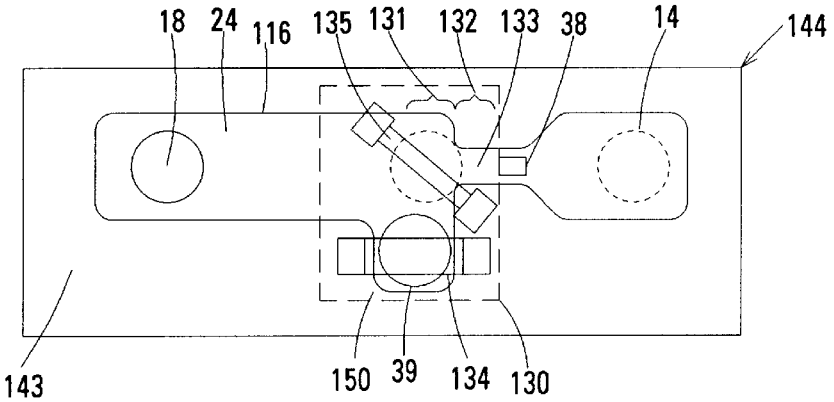
FIGS. 2B and 2C are top views of the chip that forms part of the second embodiment of the pressure regulator and bubble valve according to the invention showing alternative forms of the constriction.
Figure 2C:
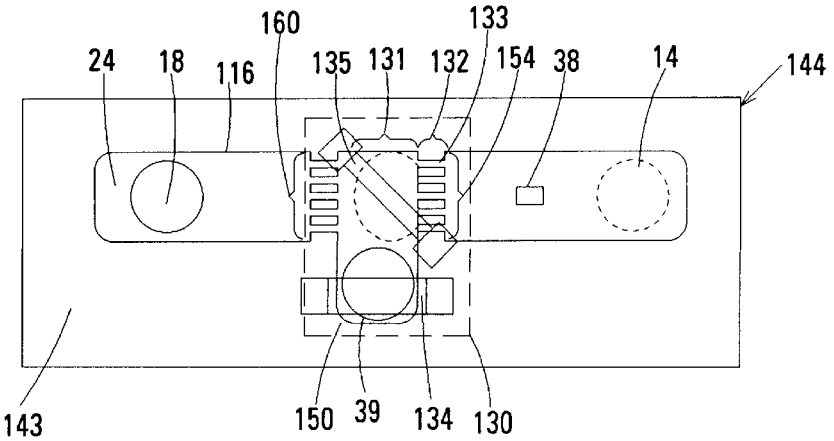

FIGS. 2A–2C show plan views of the chip 144 of three examples of a second embodiment 130 of the pressure regulator according to the invention incorporating a second embodiment of the bubble valve according to the invention. In this embodiment, the ink delivery channel 116 includes the side branch 150 where the bubble is nucleated and enlarged. The bubble moves into and out of contact with the constriction 132 in a direction substantially perpendicular to the long axis of the ink delivery channel. Nucleating and enlarging the bubble in the side branch away from the flow of ink through the ink delivery channel increases the reliability of the nucleation process and reduces the risk of small, newly-nucleated bubbles being carried downstream through the opening 133 in the constriction. Moving the bubble transversely to the direction of ink flow also requires a smaller temperature gradient. Elements of the embodiment shown in FIGS. 2A–2C that are the same as elements of the embodiment shown in FIGS. 1A–1H are indicated by the same reference numerals and will not be described in detail. The controller and the tracks connecting the controller to the heaters and the pressure sensor have been omitted from FIGS. 2A–2C to simplify the drawings.

The ink delivery channel 116 includes the upstream portion 131 and is shaped to define the constriction 132 located downstream of the upstream portion. The constriction includes the opening 133 that has a smaller cross-sectional area than the upstream portion of the ink delivery channel. The constriction is shaped to form a seal with the bubble. The ink delivery channel is additionally shaped to include the side branch 150 that extends in a generally perpendicular direction to the long axis of the ink delivery channel at the constriction. The downstream heater 135 is located adjacent the constriction. The upstream heater 134 is located in the side branch.

In the example shown in FIG. 2A, the constriction 132 is defined by the width of the ink delivery channel 16 progressively decreasing between the upstream portion 131 and the opening 133. In the example shown in FIG. 2B, the constriction 132 is defined by an abrupt decrease in the width of the ink delivery channel between the upstream portion and the opening. In the example shown FIG. 2C, the grate 154 located in the ink delivery channel downstream of the upstream portion forms the constriction 132. The grate 154 is similar to that of the grate 54 shown in FIGS. 1E and 1F, and provides the constriction with multiple openings each having a small cross-sectional area. An exemplary opening is shown at 133. The bars of the grate are defined in the barrier layer 143 in the same operation that defines the ink delivery channel including the side branch 150. The grate 154 provides the example shown in FIG. 2C with a greater breakdown pressure than that of the other two examples.

The example shown in FIG. 2C additionally includes the optional auxiliary grate 160 located in the ink delivery channel 116 between the ink inlet 18 and the side branch 150. The auxiliary grate prevents the bubble 39 from migrating upstream in the event of a negative pressure gradient occurring between the ink inlet 18 and the ink outlet 14. The examples shown in FIGS. 2A and 2B can also include auxiliary grates similar to the auxiliary grate 160. Constrictions similar to the constrictions shown in FIGS. 2A and 2B may be used instead of the auxiliary grate 160 to prevent the bubble from migrating upstream. The embodiment shown in FIGS. 1A–1E may also include an auxiliary gate or other upstream constriction.

Operation of the bubble valve 130 will now be described with reference to FIG. 2A. A voltage or current applied to the upstream heater 134 nucleates the bubble 39 in the ink, as described above with reference to FIGS. 1A–1E, and enlarges the bubble to the diameter required to form an effective seal with the constriction 132. During nucleation and growth of the bubble in the side branch 150, ink flows unimpeded through the ink delivery channel 116 to the ink outlet 14. As a result, the ink pressure in the ink outlet 14 rises towards atmospheric pressure. This rise in pressure is detected by the pressure sensor 38 located in the ink delivery channel near the ink outlet.

The maximum pressure at the ink outlet 14, i.e., the minimum pressure differential relative to atmospheric pressure, is limited by closing the bubble valve 130. The bubble valve is closed by activating the downstream heater 135 and deactivating the upstream heater 134. This causes the bubble 39 to move laterally out of the side branch 150 into the ink delivery channel 116. When the bubble comes into contact with the constriction 132, it forms a seal with the constriction and prevents ink from flowing to the ink outlet 14.

The demand for ink from the print head with the bubble valve 130 closed causes the ink pressure at the ink outlet 14 to fall. When the ink pressure has reached a predetermined minimum, i.e., a predetermined maximum pressure differential relative to atmospheric pressure, the bubble valve must be opened again to allow additional ink to flow. The upstream heater 134 is activated once more, and the downstream heater 135 is turned off The resulting temperature gradient draws the bubble 39 laterally out of the ink delivery channel 116 to the location of the upstream heater in the side branch 150. When the bubble is no longer in contact with the constriction 132, the ink can once more flow freely through the ink delivery channel.

In the examples shown in FIGS. 2A–2C, the side branch 150 extends from the ink delivery channel 116 at the location of the constriction 132. The bubble moves between the side branch and the constriction in a direction substantially perpendicular to the long axis of the ink delivery channel.

However, locating the side branch at the constriction results in the constriction having an irregular shape that does not seal well with the bubble. As a result, the bubble valve may have a relatively high leakage flow rate. In the ink pressure regulation application described herein, the ink pressure can be regulated within acceptable limits even if the bubble valve has a relatively high leakage flow rate. In applications in which a low leakage flow rate is required, leakage can be substantially reduced by locating the side branch upstream of the constriction, as in the example shown in FIG. 2D.

Figure 2D:
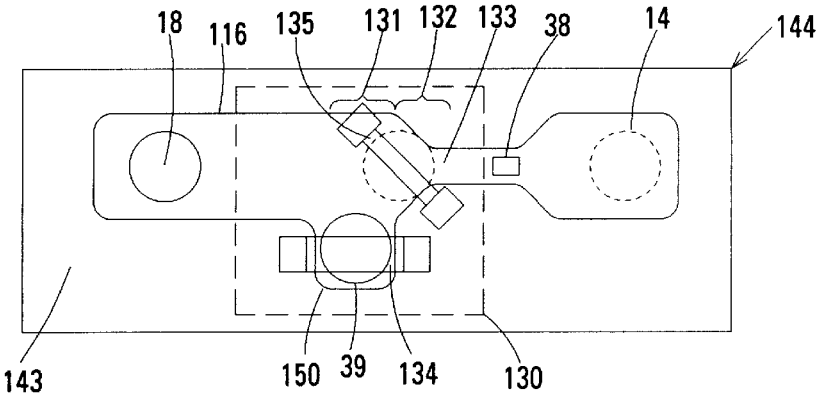
FIG. 2D is a top view of the chip that forms part of a first variation of the second embodiment of the pressure regulator and bubble valve according to the invention. In this variation, the side branch is located upstream of the constriction.

In the example shown in FIG. 2D, in which elements that are the same as in the examples shown in FIGS. 2A–2C are indicated using the same reference numerals, the side branch 150 is located upstream of the tapered portion of the ink delivery channel constituting the constriction 132. Relocating the side branch as just described enables the constriction to have symmetrically-tapering walls with which the bubble can form a low-leakage seal.

Energizing the upstream heater 134 to open the bubble valve 130 causes the bubble 39 to move laterally relative to the long axis of the ink delivery channel 116, and additionally causes the bubble to move upstream. However, a smaller temperature gradient is required to provide the upstream motion than in the embodiment shown in FIGS. 1A–1C.

Figure 2E:
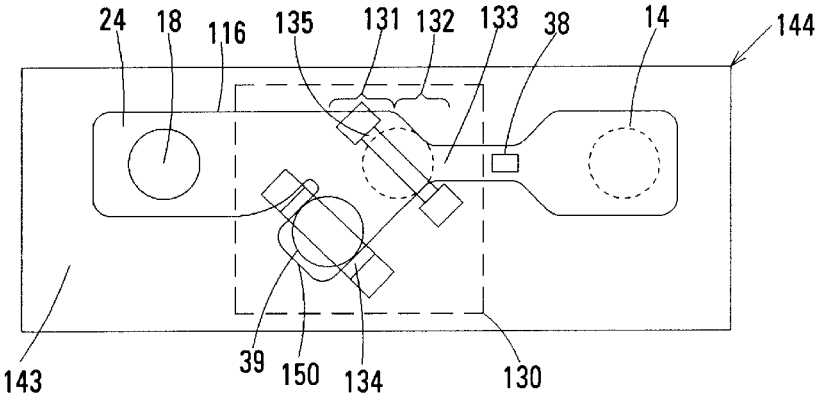
FIG. 2E is a top view of the chip that forms part of a second variation of the second embodiment of the pressure regulator and bubble valve according to the invention. In this variation, the side branch extends at an acute angle from the ink delivery channel.

The side branch 150 may extend from the ink delivery channel 116 at an acute angle, as shown in FIG. 2E.

The leakage flow rate in the variations shown in FIGS. 2B and 2C may also be reduced by moving the side branch 150 to a location upstream from the constriction 132.

Figure 3:
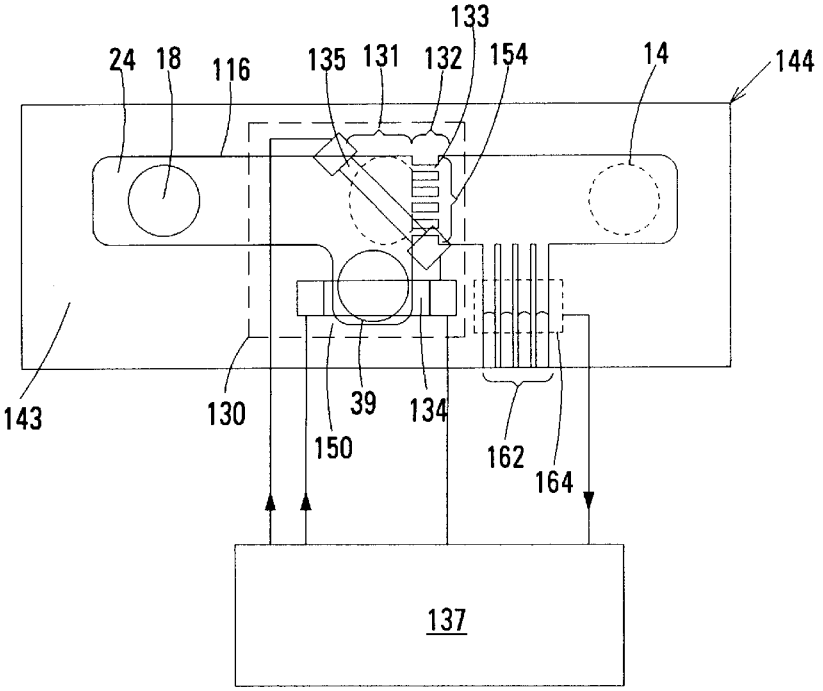
FIG. 3 is a top view of the chip that forms part of a third variation of the second embodiment of the pressure regulator and bubble valve according to the invention. This variation includes a secondary pressure regulator composed of an array of capillaries.

The peak-to-peak variation of the pressure at which the ink is delivered to the ink outlet 14 depends in part on the frequency at which the bubble valve 130 cycles between its open and closed states. The peak-to-peak pressure variation is reduced by increasing the operating frequency, but this increases the energy consumption of the valve. The peak-to-peak variation in the delivery pressure can be reduced without increasing energy consumption by using the bubble valve as a primary pressure regulator and employing a secondary pressure regulator. FIG. 3 shows the capillary array 162 as an example of a secondary pressure regulator. Passive pressure regulators composed of capillary arrays that regulate the pressure in a liquid to a predetermined differential below a reference pressure (such as atmospheric pressure) are described in the co-filed patent application entitled *Passive Pressure Regulator for Setting the Pressure of a Liquid to a Predetermined Pressure Differential Below a Reference Pressure* of Leslie A. Field et al., assigned to the assignee of this application and incorporated herein by reference. Any of the embodiments of the passive pressure regulator described in that patent application may be used as the secondary pressure regulator. For example, the capillaries constituting the capillary array may extend from the ink delivery channel through the thickness of the substrate in a direction perpendicular to the major surface of the chip 144, instead of extending parallel to the major surface as shown.

In the embodiment shown in FIG. 3, when the barrier layer 143 is selectively removed to define the ink delivery channel 116, the side branch 150 and the grate 154, the mask that defines the portions of the barrier layer to be removed (or retained) additionally defines the capillaries constituting the capillary array 162. Each capillary has a square or rectangular cross section in a plane perpendicular to the length of the capillary. Ink flows into or out of the capillary array to maintain the ink at a constant pressure differential below atmospheric pressure. The pressure differential is defined by the pressure drop across the ink surface in the capillaries. The pressure drop depends on the surface tension of the ink and the curvature of the ink surface in the capillary.

Also shown schematically in FIG. 3 is the electrode 164 which forms part of a sensor that determines the ink level in the capillary array 162. The electrode is connected to an input of the controller 137. The controller preferably uses information indicating the ink level in the capillary array in lieu of information from a pressure sensor to control the heaters 134 and 135 to open and close the bubble valve. When the controller detects that the ink level in the capillary array has risen above an upper predetermined level, it deactivates the upstream heater 134 and activates the downstream heater 135 to close the bubble valve. While the bubble valve is closed, ink flowing through the ink outlet 14 to the print head is drawn from the capillary array, causing the ink level in the capillary array to fall. When the controller detects that the ink level in the capillary array has fallen below a lower predetermined level, it deactivates the downstream heater 135 and reactivates the upstream heater 134 to open the bubble valve. With the bubble valve open, ink flowing through ink delivery channel 116 flows through the ink outlet 14 to the print head and additionally replenishes the capillary array, causing the ink level in the capillary to rise once more.

The embodiments shown in FIGS. 1A–1E, and 2A–2E can also be fitted with secondary pressure regulators, preferably capillary arrays similar to that just described.

In the embodiments described above, a bubble is nucleated, enlarged to the requisite size and is then cycled back and forth into contact with the constriction to close and open the bubble valve. In the course of such cycling, the bubble may grow in size as heating the ink neighboring the bubble contributes more gas or vapor to the bubble. The bubble may reach such a size that it blocks the upstream portion of the ink delivery channel or can no longer re-enter the side branch. If the bubble is a gas bubble, it will often be impractical to discontinue operating the bubble valve for the time required for some of the gas in the bubble to re-dissolve in the ink to restore the bubble to its original size. The time required could be of the order of hours. Consequently, in some applications at least, it is desirable for the bubble valve to include an arrangement for disposing of "used" bubbles. With such an arrangement, a bubble may be used for a number of cycles of the bubble valve, and then be disposed of. Alternatively and preferably, a new bubble may be used each time the valve is closed. In this case, the bubble is disposed of each time the valve is opened.

Figure 4A:
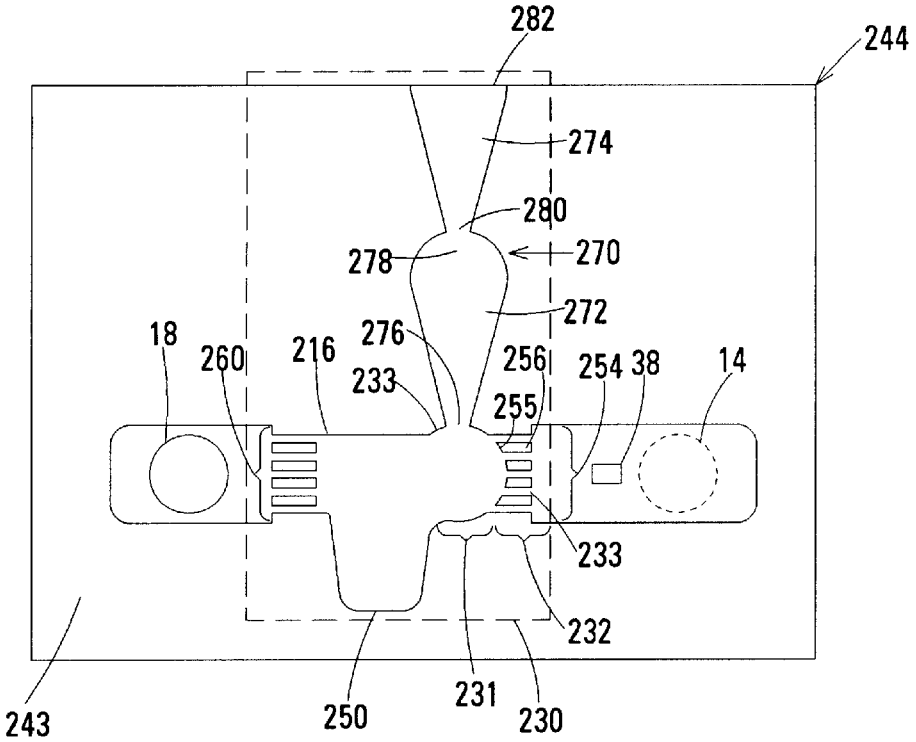
FIGS. 4A and 4B are top views of the chip that forms part of a third embodiment of a pressure regulator according to the invention incorporating a third embodiment of a bubble valve according to the invention. This embodiment includes a bubble extractor. The heaters are omitted from FIG. 4A to simplify the drawing.
Figure 4B:
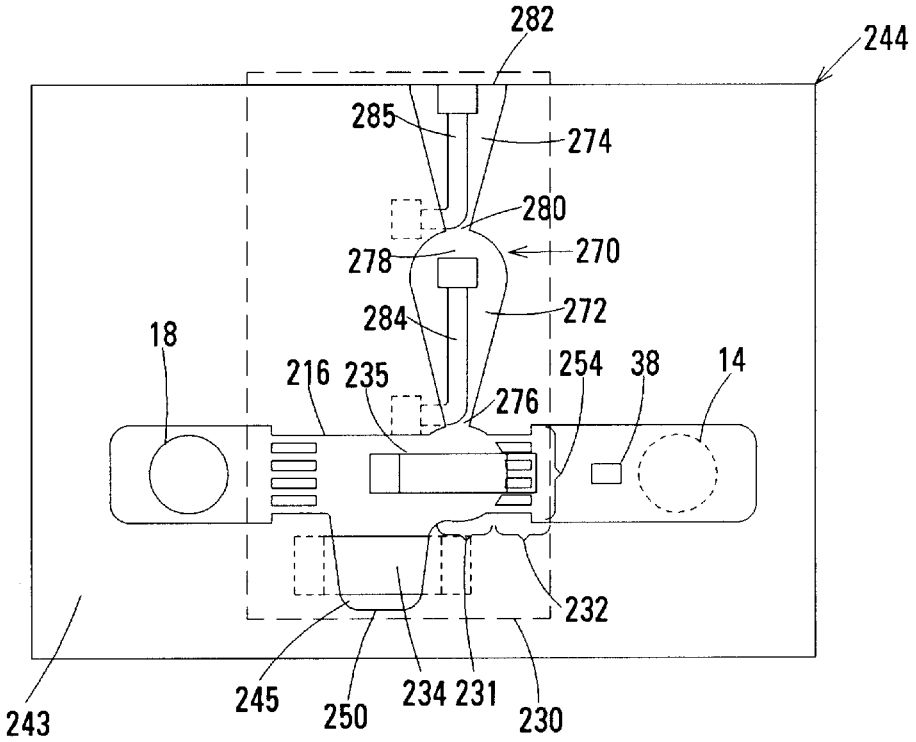

FIGS. 4A and 4B show the chip 244 of a third embodiment of the pressure regulator according to the invention that incorporates a third embodiment 230 of the bubble valve according to the invention. These embodiments include a bubble extractor that extracts "used" bubbles from the ink delivery channel. In the example shown, a new bubble is moved into contact with the constriction each time the bubble valve is closed. The bubble extractor then extracts the bubble from the ink delivery channel to open the valve. By changing the geometry of some of its components, the bubble valve may be modified to allow the bubble to close the valve in the course of a number of cycles of operation before the bubble extractor extracts the bubble from the ink delivery channel. Elements of the embodiment shown in FIGS. 4A and 4B that correspond to the embodiments shown in FIGS. 1A–1E and 2A–2E are indicated using the same reference numerals and will not be described again in detail.

FIG. 4A shows the shapes of the elements defined by selectively removing parts of the barrier layer 243 forming part of the chip 244. The ink delivery channel 216 includes the side branch 250, the upstream portion 231 and the constriction 232. The side walls of the upstream portion are shaped to lie on segments of a circle. One of the side walls of the upstream portion is indicated at 233.

In this embodiment the grate 254 located in the ink delivery channel 216 downstream of the upstream portion 231 forms the constriction 232. The constriction includes multiple openings, an exemplary one of which is shown at 233, each of which has a smaller cross-sectional area than that of the upstream portion 231. The constriction is shaped to form a seal with the bubble (not shown in FIG. 4A) by locating the upstream faces of the bars constituting the grate on the same circle as the curved side walls of the upstream portion. The upstream face of the exemplary bar 256 is shown at 255. The configuration of the upstream portion and the constriction stabilizes the position of the bubble when the valve is closed and enables the constriction to form a low-leakage seal with the bubble. The constriction configurations shown in FIGS. 2A and 2B may be used instead of the grate 254, preferably in combination with an upstream portion having curved side walls.

The ink delivery channel 216 is shaped to include the side branch 250 that extends generally perpendicularly to the long axis of the ink delivery channel. In the example shown, the side branch flares towards its mouth where it joins the ink delivery channel. The side branch is located upstream of the upstream portion 231 of the ink delivery channel so that it is well upstream of the constriction 232. Contact between the bubble and the flared shape of the side branch ejects the bubble from the side branch into the ink flow to close the valve, as will be described in more detail below. Locating the side branch well upstream of the constriction enables the topology of the constriction to be optimized to provide a low-leakage seal with the bubble. Since the bubble does not return to the side branch when the valve is opened, the side branch can be located well upstream of the upstream portion. In embodiments in which the bubble is returned to the side branch when the valve is opened, the side branch is preferably located closer to, or at, the constriction, and the side branch is not flared or is less flared, as in the examples shown in FIGS. 2A–2E.

The bubble extractor 270 provides a mechanism that opens the bubble valve 230 by extracting the bubble from the upstream portion 231 of the ink delivery channel and disposing of the bubble. Since the bubble extractor disposes of the bubbles to the atmosphere, or other source of a reference pressure, it includes a sealing arrangement that prevents it from allowing ink to leak from the ink delivery channel. The bubble extractor includes the primary extraction chamber 272, the secondary extraction chamber 274 and their associated extraction heaters. The extraction heaters will be described below. The bubble extractor extends from the upstream portion 231 of the ink delivery channel 216 preferably along a radius of the circle defined by the curved side walls of the upstream portion. The bubble extractor is shown as extending from the ink delivery channel on the side opposite the side branch 250, but may extend from the ink delivery channel on the same side as the side branch.

The primary extraction chamber 272 and the secondary extraction chamber 274 are arranged in tandem and are both flared so that their widths increase with increasing distance from the ink delivery channel. The primary extraction chamber joins the upstream portion 231 of the ink delivery channel at the narrow mouth 276 and terminates in the substantially semicircular holding portion 278. The secondary extraction chamber joins the holding portion of the primary extraction chamber at the narrow mouth 280 and terminates in the vent 282 where it is open to the atmosphere.

In the example shown, the auxiliary grate 260 is located in the ink delivery channel 216 upstream of the side branch 250 to prevent bubbles from migrating to the ink inlet 18 in the event of an inversion of the pressure gradient in the ink delivery channel. Other types of upstream constriction may be used instead of the auxiliary grate as described above. Alternatively, the upstream constriction may be omitted.

The pressure sensor 38 is located downstream of the bubble valve 230 near the location of the ink outlet 14 and measures the pressure at which ink is delivered to the ink outlet.

FIG. 4B shows the locations of the heaters in the bubble valve 230. The heaters are located on the major surface of the substrate 245 and have the same structure as the heater 34 described above with reference to FIG. 1H. The portions of the heaters shown with broken lines are underneath the barrier layer 243. In addition to the upstream heater 234 located in the side branch 250 and the downstream heater 235 located in the upstream portion 231 adjacent the constriction 232, the bubble valve 230 includes the primary extraction heater 284 and the secondary extraction heater 285 respectively located in the primary extraction chamber 272 and the secondary extraction chamber 274. Both extraction heaters are long and narrow. Each extraction heater extends form the mouth of its respective extraction chamber over most of the length of the extraction chamber. The extraction heaters are electrically connected to a controller (not shown) by conductive tracks formed on, under or over the surface of the substrate 245. Each extraction heater can be selectively energized by voltage or current provided by the controller. The controller operates in response to the pressure sensor 38 or some other way of detecting pressure as described above with reference to FIGS. 1A–1E and FIG. 3.

In some applications, the side branch 250 and the upstream heater 234 may be omitted. In this case the bubble is nucleated and enlarged by the downstream heater 235 located in the upstream portion 231 of the ink delivery channel 216, adjacent the constriction 232. If nucleation is performed by the downstream heater, the grate 254 is preferably used as the constriction to reduce the ability of the ink flow to carry small, newly-nucleated bubbles downstream past the constriction.

Operation of the bubble valve 230 will now be described with reference to FIGS. 5A–5D.

Figure 5A:
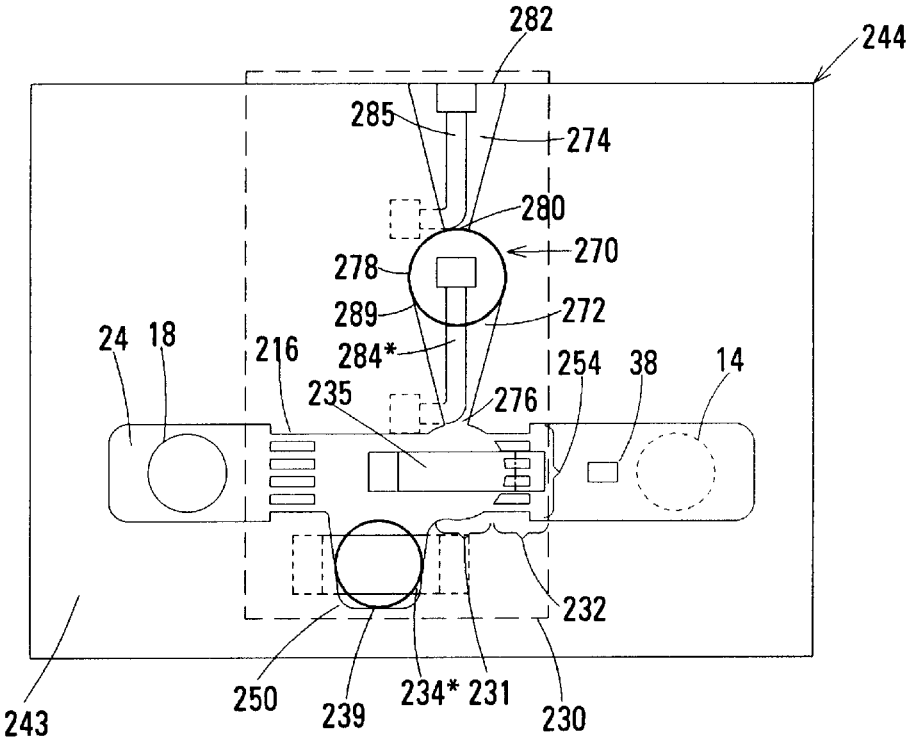
FIGS. 5A–5D are top views of the chip that forms part of the third embodiment of the pressure regulator and bubble valve according to the invention. These Figures illustrate the operation of the bubble valve.

FIG. 5A shows the bubble valve 230 in its open state. In this state, the upstream heater 234 is activated, and holds the previously-formed bubble 239 in position in the side branch 250. Additionally, the primary extraction heater 284 is activated, and maintains the bubble 289. Activated heaters are indicated by an asterisk following the reference numeral in FIGS. 5A–5D. The bubble 289 has previously been extracted from the upstream portion 231 of the ink delivery channel 216. Contact between the bubble 289 and the flared shape of the primary extraction chamber 272 holds the bubble 289 in the holding portion 278. In this position, the bubble 289 forms a seal with the mouth 280 of the secondary extraction chamber and prevents ink from leaking through the bubble extractor 270.

Figure 5B:
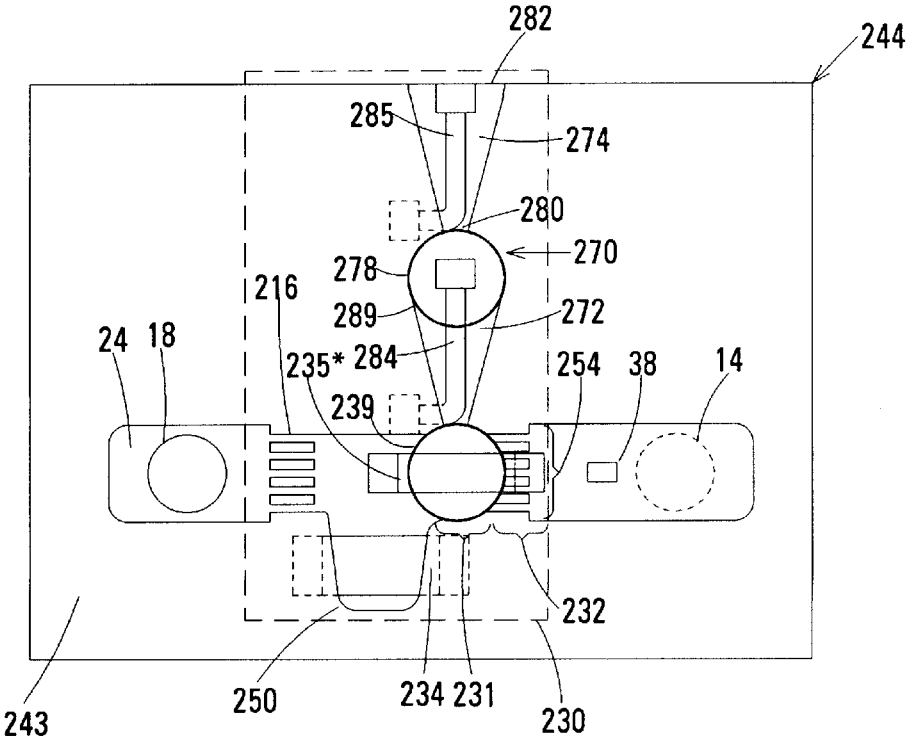

Ink flow through the ink delivery channel 216 causes the ink pressure at the ink outlet 14 to rise towards atmospheric pressure. The pressure sensor 38 located in the ink delivery channel near the ink outlet monitors the pressure at which the ink is delivered to the ink outlet. When the ink pressure reaches a predetermined maximum pressure, i.e., a predetermined minimum pressure relative to atmospheric pressure, the bubble valve 230 must close to prevent further the ink pressure from rising further. The bubble valve is closed by deactivating the upstream heater 234 and the primary extraction heater 284 and by activating the downstream heater 235. Deactivating the upstream heater and activating the downstream heater moves the bubble 239 towards the downstream heater until its progress is arrested by the grate 254, as shown in FIG. 5B. In this position, the bubble 239 forms a seal with both the constriction 232 and the mouth 276 of the primary extraction chamber 272. Consequently, the bubble 239 seals both the ink delivery channel 216 and the bubble extractor 270.

The bubble valve 230 may alternatively and preferably be closed by deactivating the primary extraction heater 284, activating the downstream heater 235, increasing the power input to the upstream heater 234 and then deactivating the upstream heater. The increased amount of heat dissipated by the upstream heater expands the bubble 239 into contact with the flared walls of the side branch 250. This generates a force directed towards the mouth of the side branch which ejects the bubble from the side branch into the ink delivery channel 216. The flow of ink through the ink delivery channel and the temperature gradient towards the activated downstream heater 235 move the bubble downstream until its progress is arrested by the grate 254. In this position, the bubble 239 forms a seal with both the constriction 232 and the mouth 276 of the primary extraction chamber 272.

Figure 5C:
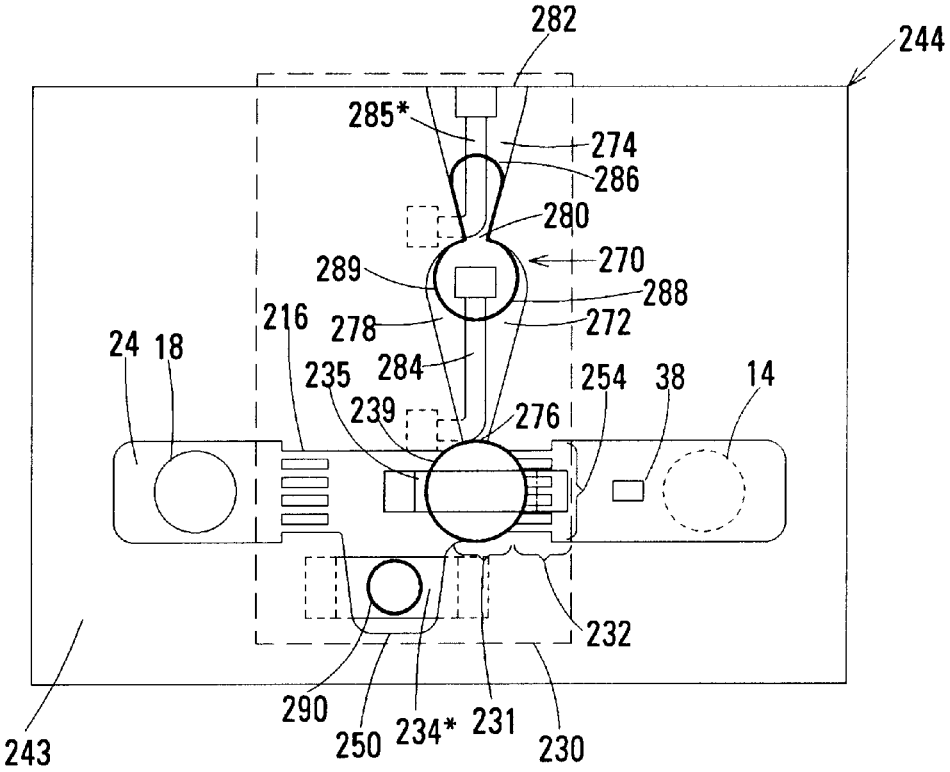

Once the bubble 239 is in place in the upstream portion 231 of the ink delivery channel sealing the mouth 276 of the bubble extractor 270, the bubble 289 is no longer needed to seal the bubble extractor and can be extracted from the primary extraction chamber 272. This is done by activating the secondary extraction heater 285 in the secondary extraction chamber 274. Since the secondary extraction heater is narrow, it generates a relatively high temperature for a given applied voltage. The resulting temperature gradient between the secondary extraction chamber and the primary extraction chamber draws the bubble 289 into the secondary extraction chamber through the narrow mouth 280, as shown in FIG. 5C. Once the bubble 289 has been drawn into the secondary extraction chamber to the extent that the radius of the part 286 of its surface in the secondary extraction chamber is greater than that of the part 288 of its surface in the primary extraction chamber, forces generated by surface tension will move the bubble fully into the secondary extraction chamber even if the secondary extraction heater is deactivated. The flared shape of the secondary extraction chamber then ejects the bubble to the atmosphere through the vent 282. FIG. 5C also shows the upstream heater 234 re-activated to nucleate a new bubble 290 ready for use next time the bubble valve 230 is closed. The downstream heater 235 may optionally be left activated to maintain the bubble 239.

Figure 5D:
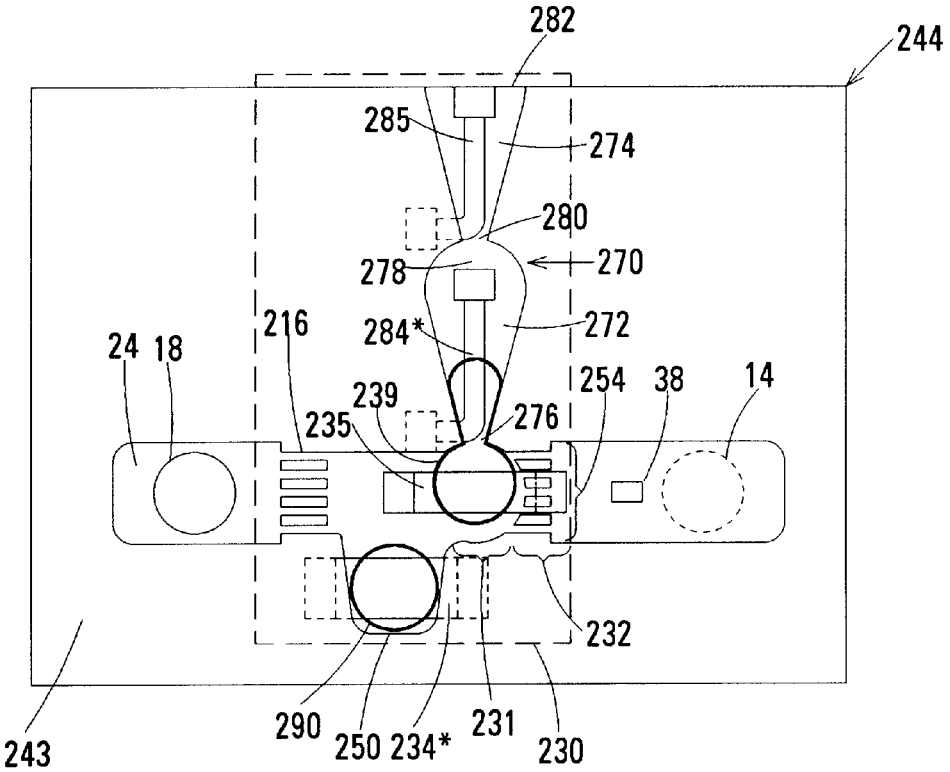

The demand for ink from the print head while the bubble valve 230 is closed causes the ink pressure at the ink outlet 14 to fall. When the pressure sensor 38 detects that the ink pressure has reached a predetermined minimum, i.e., a predetermined maximum pressure differential below atmospheric pressure, the bubble valve 230 must be opened again to allow additional ink to flow to the print head. This is done by deactivating the downstream heater 235 and the secondary extraction heater 285, and activating the primary extraction heater 284. Since the primary extraction heater is narrow, it generates a relatively high temperature for a given voltage applied to it. The resulting temperature gradient between the primary extraction chamber 272 and the upstream portion 231 of the ink delivery channel draws the bubble 239 into the primary extraction chamber through the narrow mouth 276, as shown in FIG. 5D. Once the bubble 239 has been drawn into the primary extraction chamber to the extent that the radius of the part of its surface in the primary extraction chamber is greater than that of the part of its surface in the upstream portion of the ink delivery channel, forces generated by surface tension will move the bubble fully into the primary extraction chamber even if the primary extraction heater is turned off. The flared shape of the primary extraction chamber then moves the bubble into the holding portion 278, where the bubble contacts the mouth 282 of the secondary extraction chamber 274 and seals the bubble extractor 270, as shown in FIG. 5A. FIG. 5D also shows the upstream heater 234 activated to maintain the new bubble 290 at the size required for use next time the bubble valve 230 is closed.

The bubble extractor 270 is described above with reference to an example in which the bubble extractor is composed of a tandem arrangement of a primary extraction chamber and a secondary extraction chamber, and an extraction heater in each extraction chamber. However, in bubble valves operating at relatively high pressures relative to atmospheric pressure, the tandem arrangement may include one or more additional extraction chambers, each with an extraction heater.

Figure 6:
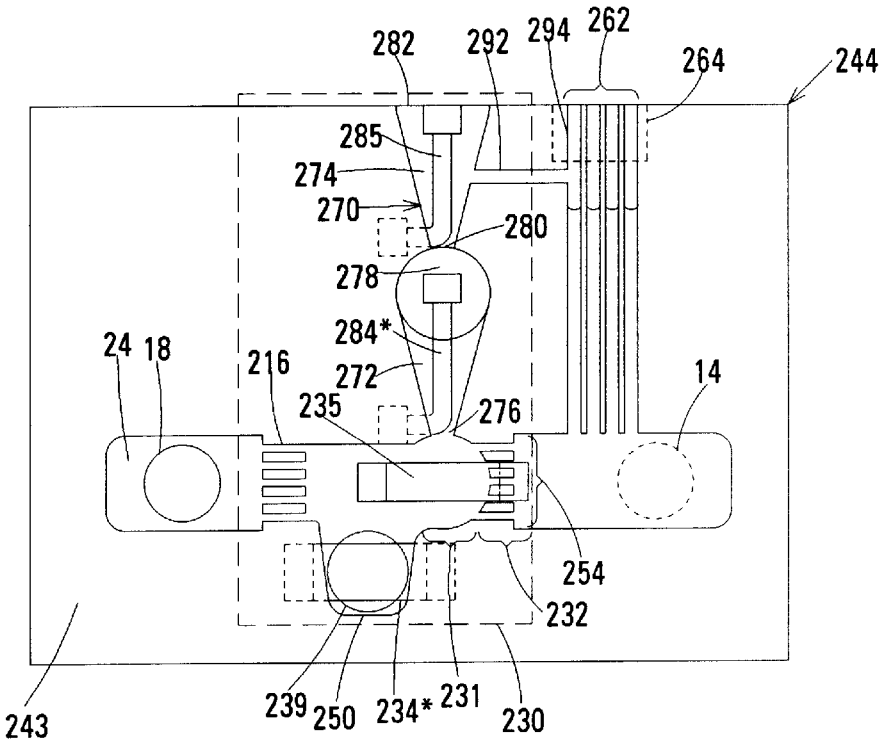
FIG. 6 is a top view of the chip that forms part of a variation of the third embodiment of the pressure regulator and bubble valve according to the invention. This variation includes a secondary pressure regulator composed of an array of capillaries and an ink return path extending between the bubble extractor and one of the capillaries of the capillary array.

The third embodiment of the pressure regulator according to the invention shown in FIGS. 4A and 4B may be fitted with a secondary pressure regulator such as the capillary array 262 shown in FIG. 6. The capillary array is similarly structured and operates similarly to the capillary array 162 shown is FIG. 3, and so will not be described again here. The electrode 264 forms part of a sensor that determines the ink level in the capillary array 262. The electrode is connected to a controller (not shown). The controller operates in response to the electrode to generate information indicating the ink level in the capillary array. The controller uses this information in lieu of information from a pressure sensor to control the heaters 234 and 235 to open and close the bubble valve.

The embodiment of the bubble valve shown in FIG. 6 additionally includes the drain path 292 interconnecting the secondary extraction chamber 274 and the capillary 294. The drain path provides a path for ink to return to the ink delivery channel 216 from the secondary extraction chamber. This prevents ink from being ejected from the vent 282. Instead, ink accumulated in the secondary extraction chamber returns to the ink delivery channel via the drain path 292 and the capillary 294. The surface tension of the ink and the angle of contact between the ink and the drain path prevent the ink in the secondary extraction chamber from entering the capillary 294 until the level of the ink surface in the capillary has risen above the junction between the drain path and the capillary. The shapes of the capillary array and the drain path are preferably defined in the barrier layer 243 as described above.

Although the invention has been described with reference to a bubble valve and pressure regulator used to regulate the pressure at which ink is delivered to the print head of an ink-jet printer, the bubble valve according to the invention may be used to control the flow of a liquid and the pressure regulator may be used to regulate the pressure of a liquid in many other applications. In applications in which the pressure of the liquid fed to the bubble valve or pressure regulator is greater than the breakdown pressure of an individual bubble valve, a multi-element bubble valve having an increased effective breakdown pressure may be made by concatenating two or more bubble valves.

Although the invention has been described with reference to embodiments of a bubble valve operated by activating and deactivating the heaters, the bubble valve may alternatively be operated by increasing or decreasing, respectively, the amount of heat dissipated by the heaters.

Although the invention has been described with reference to embodiments in which a single bubble is nucleated, enlarged and moved, aggregates of small bubbles may alternatively be nucleated, enlarged and collectively moved in lieu of a single bubble.

Although the invention has been described with reference to embodiments in which a grate is composed of a number of bars that divide the ink delivery channel into corresponding channels of equal width, this is not critical to the invention. The grate can be composed of as few as one bar, and the channels can have unequal widths as long as the cross-sectional area of the widest channel is less than that of the upstream portion of the ink delivery channel.

Although this disclosure describes illustrative embodiments of the invention in detail, it is to be understood that the invention is not limited to the precise embodiments described, and that various modifications may be practiced within the scope of the invention defined by the appended claims.

We claim:

1. A bubble valve for controlling flow of a liquid in a flow direction, the bubble valve comprising:

a liquid delivery channel, including:

an upstream portion having a cross-sectional area, and a constriction downstream of the upstream portion, the constriction including an opening having a cross-sectional area smaller than the cross-sectional area of the upstream portion; and localized heating means located in the liquid delivery channel for generating heat to nucleate and enlarge a bubble in the liquid; in which:

the constriction is shaped to form a seal with the bubble; and the localized heating means is additionally for generating heat to shift the bubble relative to the constriction to control the flow of the liquid.

2. The bubble valve of claim 1, in which the localized heating means includes:

a downstream heater located adjacent the constriction; and an upstream heater located upstream of the downstream heater.

3. The bubble valve of claim 1, in which:

the liquid delivery channel additionally includes a side branch located one of (a) at, and (b) upstream of the constriction; and the localized heating means includes:

a downstream heater located adjacent the constriction, and an upstream heater located in the side branch.

4. The bubble valve of claim 3, in which the side branch is located upstream of the constriction.

5. The bubble valve of claim 3, in which:

the constriction is a first constriction; and the upstream portion is shaped to define a second constriction upstream of the side branch.

6. The bubble valve of claim 3, in which the side branch extends at an acute angle from the ink delivery channel.

7. The bubble valve of claim 3, in which the upstream heater nucleates and enlarges the bubble.

8. The bubble valve of claim 1, in which the constriction comprises a region in which the cross-sectional area of the liquid delivery channel reduces progressively.

9. The bubble valve of claim 1, in which the constriction comprises a region in which the cross-sectional area of the liquid delivery channel reduces abruptly.

10. The bubble valve of claim 9, in which the constriction comprises a grate located in the liquid delivery channel.

11. The bubble valve of claim 1, in which:

the bubble valve additionally comprises a flared channel having a length and a cross-sectional area that increases along the length; and the localized heating means moves the bubble relative to the constriction by expanding the bubble into contact with the flared channel, contact between the bubble and the flared channel moving the bubble along the length of the flared channel.

12. The bubble valve of claim 1, additionally comprising a bubble extractor extending from the liquid delivery path upstream of the constriction.

13. The bubble valve of claim 12, in which the bubble extractor includes:

a tandem arrangement of a first extraction chamber and a second extraction chamber, each of the extraction chambers having a width that flares with increasing distance from the liquid delivery channel, the first extraction chamber terminating in a constriction shaped to form a seal with the bubble, the second extraction chamber terminating in a vent; and an elongate extraction heater located in each extraction chamber.

14. The bubble valve of claim 13, in which:

the upstream portion of the liquid delivery channel includes curved sidewalls shaped to lie on segments of a circle;

the constriction includes a grate located in the liquid delivery channel, the grate including plural bars having respective upstream faces, the bars being shaped so that the upstream faces lie on the circle;

the liquid delivery channel additionally includes side branch located upstream of the upstream portion;

the localized heating means includes:

a downstream heater located adjacent the constriction, and an upstream heater located in the side branch; and the bubble extractor extends from the upstream portion.

15. The bubble valve of claim 1, in which:

the liquid delivery channel includes a floor and side walls, the side walls forming square corners with the floor; and the bubble valve additionally comprises fillets filling the square corners between the sidewalls and the floor of the liquid delivery channel.

16. The bubble valve of claim 15, in which: the bubble valve additionally comprises:

a substrate on which the localized heating means is located, the substrate including single-crystal silicon, and a barrier layer supported by the substrate and including a high aspect ratio photoresist, portions of the barrier layer being removed to define the liquid delivery channel, the barrier layer and the substrate respectively constituting the floor and the side walls of the liquid delivery channel, the side walls forming square corners with the floor; and the fillets include epoxy.

17. The bubble valve of claim 1, additionally comprising a pressure regulator coupled to the liquid delivery channel downstream of the constriction, the pressure regulator including an array of capillaries.

18. A pressure regulator for regulating pressure at which liquid is delivered to a liquid outlet, the pressure regulator comprising:

a liquid delivery channel connected to the liquid outlet, the liquid delivery channel including:

an upstream portion having a cross-sectional area, and a constriction located between the upstream portion and the liquid outlet, the constriction including an opening having a cross-sectional area smaller than the cross-sectional area of the upstream portion;

a sensor located adjacent the liquid outlet;

a controller that operates in response to the sensor;

localized heating means, operating in response to the controller, for generating heat to nucleate and enlarge a bubble in the liquid, the localized heating means being located in the liquid delivery channel; in which:

the constriction is shaped to form a seal with the bubble; and the localized heating means is additionally for generating heat to shift the bubble relative to the constriction to control the flow of the liquid to the liquid outlet.

19. The pressure regulator of claim 18, in which the localized heating means includes:

a downstream heater located adjacent the constriction; and an upstream heater located upstream of the downstream heater.

20. The pressure regulator of claim 18, in which:

the liquid delivery channel additionally includes a side branch located one of (a) at, and (b) upstream of the constriction; and the localized heating means includes:

a downstream heater located adjacent the constriction, and an upstream heater located in the side branch.

21. The pressure regulator of claim 18, in which the constriction comprises a region in which the cross-sectional area of the liquid delivery channel reduces progressively.

22. The pressure regulator of claim 18, in which the constriction comprises a region in which the cross-sectional area of the liquid delivery channel reduces abruptly.

23. The pressure regulator of claim 22, in which the constriction comprises a grate located in the liquid delivery channel.

24. The pressure regulator of claim 18, additionally comprising a bubble extractor extending from the liquid delivery channel upstream of the constriction.

25. The pressure regulator of claim 24, additionally comprising:

a secondary pressure regulator including an array of capillaries in which the pressure at which the liquid is delivered to the liquid outlet is determined by a pressure drop across a liquid surface in the capillaries; and a liquid return path interconnecting the bubble extractor and one of the capillaries.

26. The pressure regulator of claim 18, additionally comprising a secondary pressure regulator located adjacent the liquid outlet.

27. The pressure regulator of claim 26, in which the secondary pressure regulator includes an array of capillaries in which the pressure at which the liquid is delivered to the liquid outlet is determined by a pressure drop across a liquid surface in the capillaries.

28. The pressure regulator of claim 26, in which the sensor includes means for detecting a level of the liquid in the capillaries.

* * * * *